US009631370B2

(12) United States Patent
Paton

(10) Patent No.: US 9,631,370 B2
(45) Date of Patent: Apr. 25, 2017

(54) GUTTER CLEANING APPARATUS

(71) Applicant: Murray Andrew Paton, Hurlingham (ZA)

(72) Inventor: Murray Andrew Paton, Hurlingham (ZA)

( * ) Notice: Subject to any disclaimer, the term of this patent is extended or adjusted under 35 U.S.C. 154(b) by 35 days.

(21) Appl. No.: 14/653,772

(22) PCT Filed: Dec. 20, 2013

(86) PCT No.: PCT/IB2013/061194
§ 371 (c)(1),
(2) Date: Jun. 18, 2015

(87) PCT Pub. No.: WO2014/097246
PCT Pub. Date: Jun. 26, 2014

(65) Prior Publication Data

US 2016/0201330 A1 Jul. 14, 2016

(30) Foreign Application Priority Data

Dec. 20, 2012 (ZA) ..... 2012/09766

(51) Int. Cl.
*A47L 5/14* (2006.01)
*E04D 13/076* (2006.01)
(Continued)

(52) U.S. Cl.
CPC ..... *E04D 13/0765* (2013.01); *A47L 5/24* (2013.01); *B08B 5/02* (2013.01)

(58) Field of Classification Search
CPC ..... E04D 13/076; E04D 13/0765; B08B 5/02; A47L 5/14; A47L 5/24; A47L 5/225
(Continued)

(56) References Cited

U.S. PATENT DOCUMENTS 4,121,320 A 10/1978 Feiner
4,450,793 A 5/1984 Sumiyoshi et al.
(Continued)

FOREIGN PATENT DOCUMENTS

DE 4008062 A1 11/1990
DE 20 2006 013 788 U1 7/2007

*Primary Examiner* — David Redding
(74) *Attorney, Agent, or Firm* — Mucy, Geissler, Olds & Lowe, P.C.

(57) ABSTRACT

The invention provides an air operated cleaning head for a roof gutter. The head has a housing defining an airflow passage with an impeller located inside the passage. A gear arrangement connects the impeller to a drive shaft for a pair of driven wheels. Guide formations maintain the wheels in engagement along an outer rail of a roof gutter. The guide formations are configured to straddle the rail with a counterbalance provided to maintain the head in balancing engagement on the rail. The counterbalance is an underslung air supply downpipe extending pivotably from the head The guide formations are provided as a radial flange on the outside of the wheels and a radial spoke arrangement on the inside of the wheels. The spoke arrangement is freely rotatable on the wheel axles. The impeller is supported in a dividing wall of the flow passage. Drive shaft switching means includes a flap valve movable between seats on opposite sides of the dividing wall to reverse rotation of the impeller and thus also the wheels. The flap valve is secured to a pivot pin with a lever extending from the pin away from the flap valve connected to the downpipe by a spring, whereby pivoting of the downpipe in one direction produces a bias on the flap valve in an opposite direction.

17 Claims, 4 Drawing Sheets

(51) Int. Cl.
*A47L 5/24* (2006.01)
*B08B 5/02* (2006.01)

(58) Field of Classification Search
IPC ..... A47L 5/14
See application file for complete search history.

(56) References Cited

U.S. PATENT DOCUMENTS

| | | | | |
|---|---|---|---|---|
| 5,573,024 | A | 11/1996 | DeVaney et al. | |
| 7,802,338 | B1 * | 9/2010 | Hall | A47L 7/0009 15/23 |
| 2008/0216869 | A1 * | 9/2008 | Dayton | B08B 9/00 134/6 |

* cited by examiner

GUTTER CLEANING APPARATUS

FIELD OF THE INVENTION

The invention relates to a fluid operated head and apparatus for cleaning or clearing leaves and debris from a rainwater roof gutter. In particular, the invention relates to air operated equipment for use as an accessory to a suitable blower.

BACKGROUND TO THE INVENTION

A large number of gutter-cleaners have been proposed. The equipment conventionally uses pressurized air or water or an air vacuum to remove debris. Despite the many variations of such equipment, very few models have actually gained commercial acceptance.

One version that is in use involves extensions fitted to a conventional leaf blower that allow manual access from the ground for an operator to direct airflow into a gutter and blow out the accumulated debris.

In the case of mobile equipment designed to travel along a gutter, various roof edge formations and any supports/brackets extending across the gutter present obstructions, which generally vary from roof to roof.

OBJECT OF THE INVENTION

It is an object of the invention to provide apparatus for cleaning or clearing leaves and debris from a rainwater roof gutter that is more universal in its application, overcomes difficulties of the prior art and/or is convenient and effective in use.

SUMMARY OF THE INVENTION

In accordance with a first aspect of the invention there is provided an air operated cleaning head for a roof gutter comprising a housing defining an airflow passage with an impeller located inside the passage, a gear arrangement connecting the impeller to a drive shaft and the drive shaft connected to at least one driven wheel of a wheel arrangement with guide formations to maintain the wheel arrangement in engagement along an outer rail of a roof gutter.

Further features of the first aspect of the invention provide for the head to be locatable above the rail with an underslung counterbalance securable to the head to maintain it in balancing engagement on the rail.

In accordance with a second aspect of the invention there is provided a fluid operated cleaning head comprising a wheel arrangement to engage an outer rail of a roof gutter with guide formations configured to straddle the rail and keep the wheel arrangement on the rail and an underslung counterbalance to maintain the head in balancing engagement on the rail.

Further features of the first aspect of the invention provide for the head to be air operated and have a housing defining an airflow passage with an impeller located inside the passage and a gear arrangement connecting the impeller to a drive shaft connected to drive at least one wheel of the arrangement.

Further features (of both aspects of the invention) provide a cleaning head as defined in which the counterbalance is an underslung air supply downpipe extending from the head; and in which the downpipe is pivotably secured to the head.

Further features (of both aspects of the invention) provide a cleaning head as defined in which the guide formations are spaced apart and configured to straddle the rail; in which the guide formations are provided on either side of at least one wheel of the wheel arrangement; in which the guide formations include at least one radial flange on the at least one wheel; in which the guide formations include a radial spoke arrangement on the inside of the at least one wheel; and in which the spoke arrangement is freely rotatable on an axle of the at least one wheel.

Further features (of both aspects of the invention) provide a cleaning head as defined in which the head includes a drive shaft switching means to reverse the rotation of the at least one driven wheel; in which the impeller is supported in a dividing wall of the flow passage and for the switching means to alternate flow of air to either side of the wall; and in which the switching means includes a flap valve movable between seats on opposite sides of the dividing wall.

A further feature (of both aspects of the invention) provide a cleaning head as defined in which a flap valve is secured to a pivot pin with a lever extending from the pin away from the flap valve connected to the downpipe by a spring, whereby pivoting of the downpipe in one direction produces a bias on the flap valve in an opposite direction.

Further features (of both aspects of the invention) provide a cleaning head as defined in which the wheel arrangement includes a pair of inline, spaced apart wheels; in which both of the wheels are driven and each wheel is connected to the drive shaft by a belt; and in which the head is an air blowing head with the downpipe connectable to a flexible hose extending from a blower.

Further features (of both aspects of the invention) provide a downpipe for use with a cleaning head as defined, the downpipe comprising a first connection to the head and a second connection to a fluid line with a hollow, cranked body extending between the connections and configured to underlie the head and balance the head for guided movement along a gutter; and the downpipe having a cranked section of the body which depends from a substantially perpendicular first connection and the cranked section includes two substantially parallel conduits with a connecting crank inclined between the conduits.

BRIEF DESCRIPTION OF THE DRAWINGS

These and other features of the invention will become more apparent from the following description, by way of example only, with reference to the accompanying drawings in which.

DETAILED DESCRIPTION OF THE INVENTION

Figure 1:
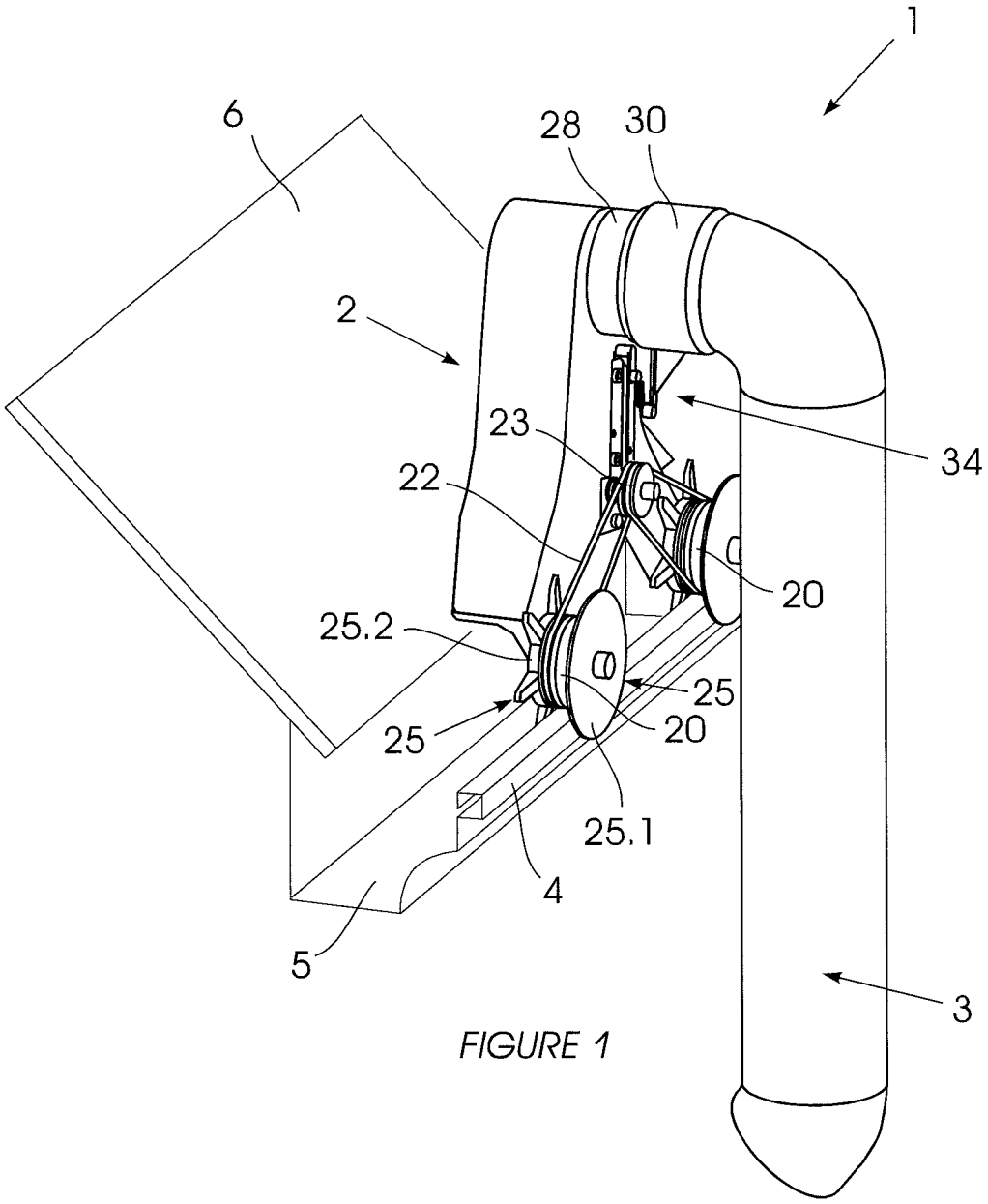
FIG. 1 shows a perspective view of a gutter cleaner balanced on the outer rail of a gutter.

Referring to the drawings, air operated cleaning apparatus in accordance with the invention is indicated generally by reference numeral (1). The apparatus (1) includes a head (2) to which a downpipe (3) is removably securable. The first two drawings show the head (2) fitted in place on an outer rail (4) of a gutter (5) secured in the usual manner at the edge of a roof (6) to collect runoff rainwater.

The head (2) provides a housing defining an airflow passage (7) therethrough. An impeller (8) is located inside the passage (7), between an inlet (9) and two diverging branches (10) and (11). More specifically, the impeller (8) is supported in a wedge-shaped dividing wall (12) that bisects the flow passage (7). The housing is provided with an inverted "V" shape. Each of the diverging branches (10) and (11) is provided with an outlet (13). The two outlets (13) are directed downwardly and outwardly to respectively deliver an airflow stream into the gutter (5) during use.

The impeller (8) has a shaft (14) that is connected through a gear arrangement (15) to a drive shaft (16). In this example, a reduction gear (17) is provided between a prime gear (18) on the impeller shaft (14) and a driven gear (19) on the drive shaft (16). The drive shaft (16) is in turn connected to drive a pair of inline, spaced apart wheels (20). The wheels (20) provide a wheel arrangement for the head (2) to travel along the gutter rail (4).

Figure 2:
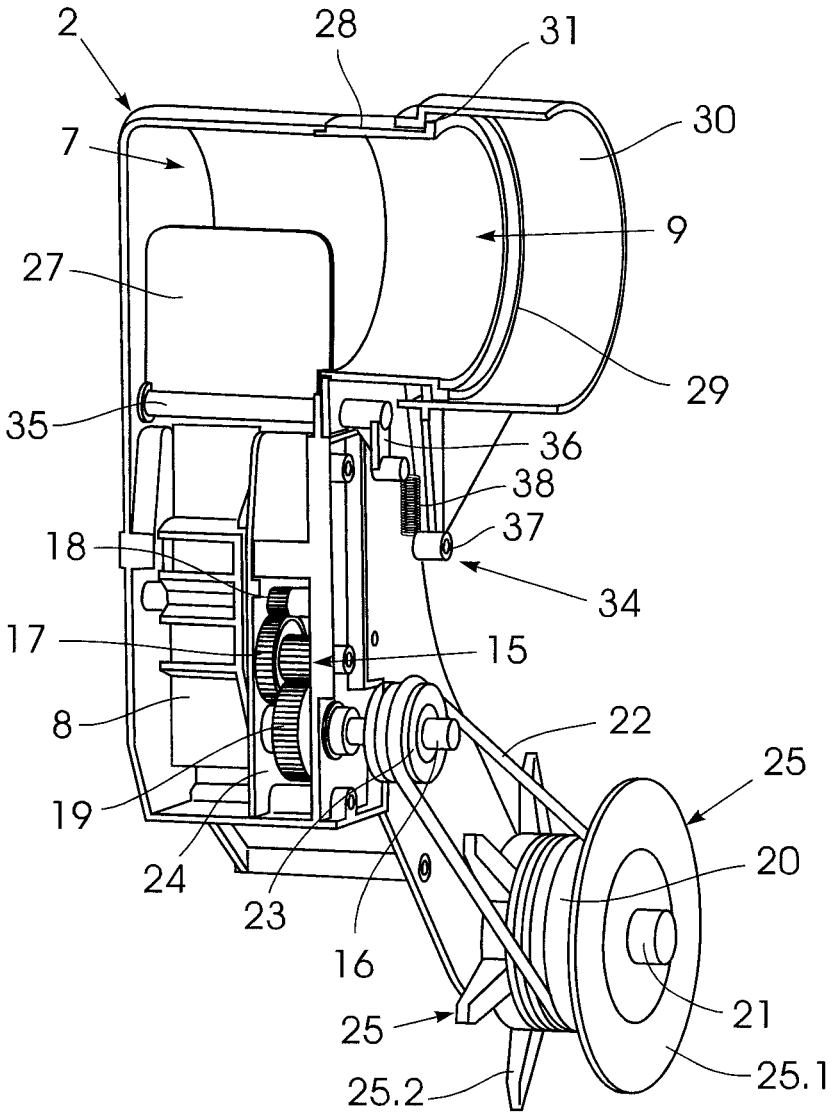
FIG. 2 shows a cross-sectional perspective view of the cleaning head without the downpipe.
Figure 3:
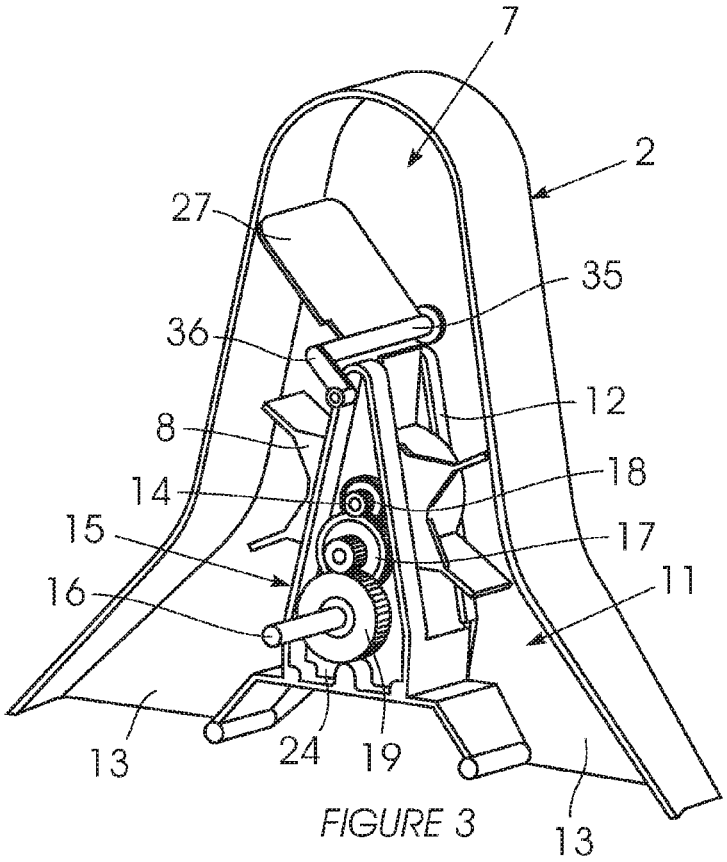
FIG. 3 shows a perspective view of the impeller and gear arrangement cleaning head.

Each wheel (20) runs on an axle (21) and is connected to the drive shaft (16) by a belt (22). The shaft (16) is fitted with a suitable pulley (23) and the wheels (20) each have a circumferential groove providing a belt track which enable the connection. In this embodiment, the pulley (23) and the wheels (20) each have a pair of parallel grooves. The grooves of the respective components are aligned in the assembly. This allows the pulley (23) to be used with a pair of belts (22), one for each wheel (20). This also provides that a component from a single mould can be used for both wheels (20). The gear arrangement (15) which is housed in a chamber (24) provided within the dividing wall (12) can be most clearly seen from FIGS. 2 and 3.

The head (2) and more specifically, in this embodiment, the wheels (20) include guide means (25) configured to straddle the rail (4) and to maintain the wheels (20) in engagement along a rail (4). The downpipe (3) extending from the head (2) as illustrated provides an underslung counterbalance to maintain the head (2) in balancing relationship on the gutter (5) with only its wheels (20) engaging the rail (4) subject to the guided contact provided by the guide means (25).

The guide means is provided as spaced apart guide formations (25) located on either side of the wheels (20). The construction of such formations may be varied. The wheels (20), for example, could be arranged in an inverted channel which runs over the rail (4). In this example, however, the guide formations are radial flanges (25.1) secured to the outside of each of the wheels (20) and an inner radial spoke arrangement (25.2) which is freely rotatable on each wheel axle (21). These formations (25.1; 25.2) provide the wheels (20) themselves with a channel profile.

In the case where a gutter (5) is traversed by cross braces or hangers (not shown) the radial spokes of the arrangement (25.2), which run on the inside of the rail (4), are suitably spaced to pass over the hangers on rotation of the wheels (20) along the upper edge of the rail (4) for substantially uninterrupted travel. The free rotation of the spoke arrangements (25.2) will accommodate the position of the hangers independent of the rotation of the wheels (20) along the rail edge, past these obstacles. The spacing of the spokes is selected to fit over the hangers.

As a feature of the invention, the head (2) is provided with drive shaft switching means. This serves to reverse the rotation of the drive shaft (16) and thus also the wheels (20). The example of the switching means illustrated is operated by manual actuation determined by positioning of the downpipe (3), as described below.

The switching means is designed to alternate flow of air to either side of the dividing wall (12). The switching means includes a valve (27) movable between seating positions on opposite sides of the dividing wall (12). The valve is provided as a flap valve (27) pivoted in line with and to the upstream side of the dividing wall (12).

A hollow spigot (28) extending laterally from the head (2) provides the inlet (9) to the flow passage (7). The spigot (28) is outwardly stepped to provide a retaining rim (29) for a pivoting connection sleeve (30). The sleeve (30) is sized to fit over the spigot (28). This is done before the spigot (28) is secured to the housing of the head (2).

Figure 4:
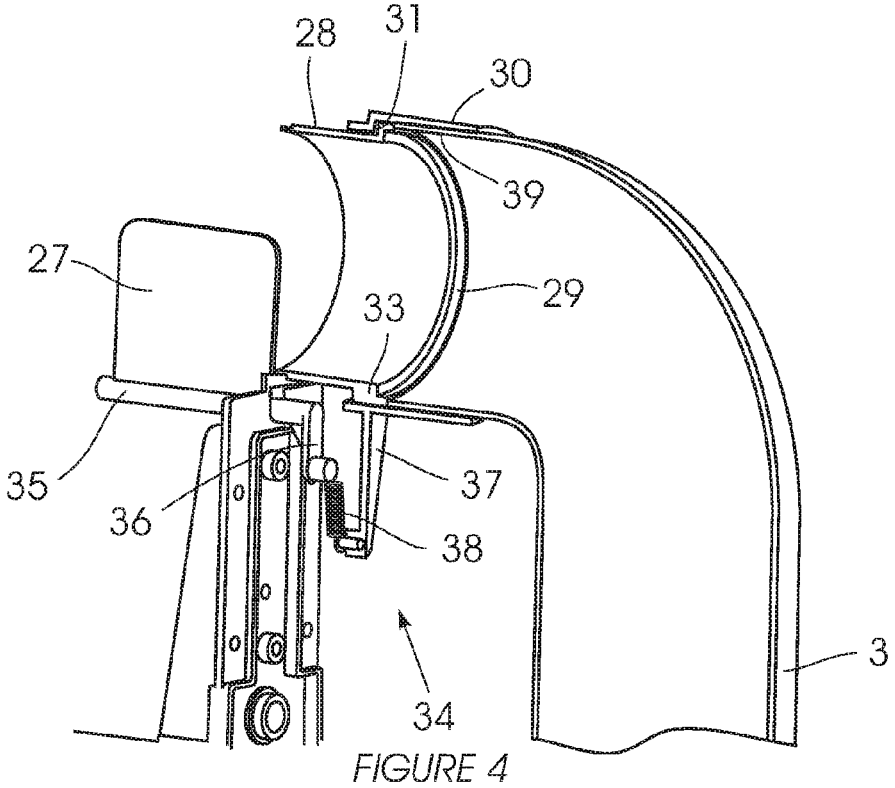
FIG. 4 shows a perspective view of the switching valve, direction change mechanism.
Figure 5:
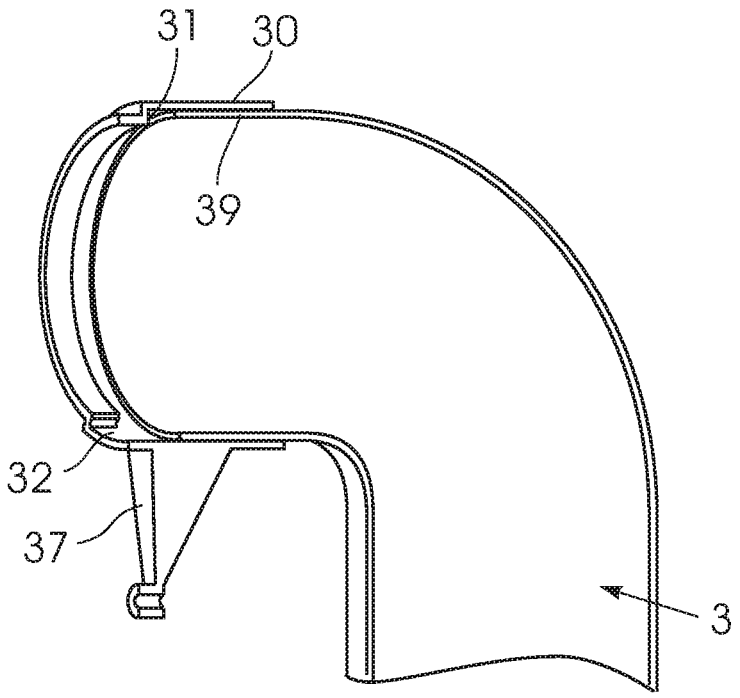
FIG. 5 shows a cross-sectional perspective view of the downpipe.
Figure 6:
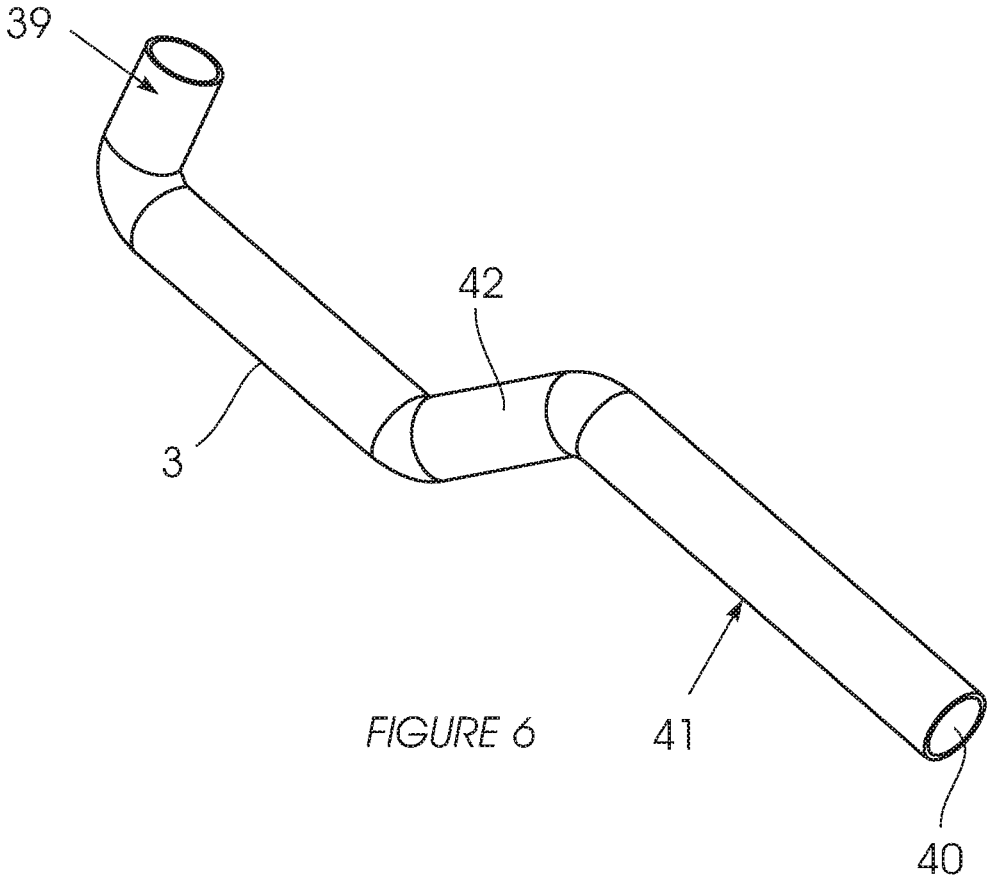
FIG. 6 shows a perspective view of the downpipe.

The sleeve (30) is stepped inwardly to provide a shoulder (31) which abuts the rim (29). The shoulder (31) is interrupted by a recess (32) which extends as an arc along the operatively lower end of the connection sleeve (30)—this can be seen more clearly in FIG. 5. A stop (33) is provided at the operatively lower end of the spigot (28), extending radially outwardly from the spigot (28)—see FIG. 4. The stop (33) locates inside the recess (32) and limits pivoting of the connection sleeve (30) on the spigot (28). The rim (29) and shoulder (31) are freely rotatable relative to each other however the side edges of the recess (32), from where the shoulder (31) extends limit the relative rotation when they reach the stop (33) at the bottom of the spigot (28).

The switching means includes a suitable linkage (34) connecting a pivot pin (35) which supports the valve (27) to the pivotable sleeve (30). A downwardly extending lever (36) is fixed to the pivot pin (35)—the lever (36) and valve (27) are oppositely disposed. The linkage (34) includes a downwardly extending connecting arm (37) which is secured to the sleeve (30). The arm (37) is connected to the lever (36) by a tension spring (38).

Depending on the path of the airflow, directed to either side of the dividing wall (12), the impeller (8) will rotate in one direction or the other. The outlets (13) are thus supplied alternately and direct airflow into and along the gutter (5) in opposite directions, depending on the position of the valve (27).

The downpipe (3) includes a first connection provided as a spigot (39) which is secured into a socket provided by the sleeve (30). The spigot (39) will be a friction fit into the socket (30) and will additionally be secured in place by screws or rivets. A second connection (40) is provided at the opposite end of the downpipe (3) for engagement with an air supply line (not shown).

A hollow, cranked body (41) extends between the connections (39) and (40) of the downpipe (3). The body (41) is configured to underlie the head (2) and balance the head (2) for guided movement along a gutter (5). A cranked section (42) of the downpipe body (41), is provided between the two connections (39) and (40).

The connection between the head (2) and downpipe (3) provides for limited pivoting between these components.

The pivot or swivel connection of the downpipe (3) prevents the transfer of a turning moment to the head (2) on acceleration or deceleration of the travel speed and when the head (2) reverses direction. The momentum of the downpipe (with the suspended hose connector) would otherwise act through this component as a lever and tend to rock the head (2) onto one of the spaced apart wheels. The downpipe (3) can instead rock independently of the head (2) on the pivot connection. This feature accordingly serves to stabilize the head (2) and keep both wheels (20) in contact with the rail (4) during operation.

Once the apparatus (1) is assembled and connected to the blower (not shown), the head (2) is located onto the gutter edge with the wheels (20) and guide formations (25.1; 25.2) straddling the rail (4). This placement of the head (2) can be achieved by holding the downpipe (3) to lift the device onto a gutter in the case of single storey buildings.

The apparatus (1) will balance itself on the gutter rail (4) due to the self-balancing/stabilizing design. With the apparatus (1) in place, the blower is started. The flow of air at relatively high velocity is ducted from the blower to the head (2) through the flexible hose connector (not shown) and through the downpipe (3). The flow of air is directed through the head (2) into the gutter (5) via the impeller, imparting rotation thereto.

The speed of movement of the head (2) as it travels along the gutter (5) is determined by the leaf blower output, turbine rotation and gear ratios. The higher the power setting of the blower, the faster the head will move and the harder it will blow into the gutter. A higher power setting of the blower is preferable for displacement of debris. Where this results in an excessive rate of travel along the gutter, an operator may slow the movement of the device (or even hold the device stationary) by pulling against the downpipe causing the wheels to slip on the gutter rail.

To reverse the direction of travel, an operator will pivot the downpipe (3) to the trailing side of the moving head (2)—this will also be the side to which the flap valve (27) is seated with air blowing out of the leading outlet to the front of the advancing head (2).

This positioning of the downpipe (3) correspondingly moves the arm (37). The displacement of the arm (37) in turn tensions the spring (38) and creates a bias on the end of the lever (36) which acts through the pivot pin (35) on the seated flap valve (27).

While the blower is operating at higher power settings, the flow of air holds the flap valve (27) seated and resists the bias of the spring (38). However, with the downpipe (3) in this position, when the blower operation is taken down to an idle, the removal of the airflow force on the flap valve (27) allows the spring (38) to displace the lever (36) and pivot the valve (27) past the centre line of the dividing wall (12) towards the opposite passage (10 or 11). When the blower is again accelerated the valve (27) is biased towards the other seat, switching flow of air through the head (2) and reversing the rotation direction of the turbine (8).

The head (2) will remain connected to the rail (4) of the gutter (5) in a stable manner whether it is in motion or stationary (when the blower is idling or switched off). This will also be the case if the blower is disconnected.

The invention accordingly provides apparatus for clearing/cleaning loose or other relatively easily dislodged debris, particularly leaves from roof gutters. The invention finds application in both a domestic and a commercial environment.

The head (2) can most easily be used on first floor roof structures but may also be used on higher roofs or double storey buildings. This will be done making use of a suitably long rigid extension or connector (consisting of multiple sections of straight downpipe) secured below the downpipe (3) or with the use of a shepherd's type pole (not shown). In the case of the latter, a longer flexible pipe will be fitted between the normal downpipe and blower. The shepherd's pole will be provided with a U-shaped crook at the end to fit under the spigot of the downpipe where it joins the head and will allow an operator to raise the apparatus up to the second storey gutter. A curved end of the pole can also be used to dislodge stubborn debris from the gutter that can then be blown out by the device.

The head (2) does not need to be placed in position using a ladder or similar implement to reach up to the gutter and is therefore easy to use and quick to install. This also reduces risk of injury or damage, requires less effort and saves time.

The gutter clearing apparatus is suitably shaped and sized to allow it to operate without interference in most gutter environments and should not snag on nearby structures, such as roof surface overhangs. The head is balanced and guided independently of the roof formation, surface or edge adjacent the gutter and relies solely on what is a generally uniform rail associated with most gutters as a track for guided movement. The head and downpipe are thus designed for operation in spaced apart relationship to any roof structure associated with a gutter.

The apparatus can be made in varying sizes, for example: standard size and durability for a domestic use; and larger size and greater durability for commercial use by contractors. While the apparatus is preferably air powered and of the blowing type, the scope of the invention will extend to embodiments that include air suction cleaners or cleaning heads that use pressurized water to flush a gutter.

The housing provided by the head can be made of any suitable materials that are appropriately light, strong and commercially viable. This may include, but is not limited to, some or all of the following: ABS plastics, polyurethane, polyethylene or fibre-based materials. The internal component parts of the head can be made of any of the above or steel, brass, aluminium or other metals.

The dimensions of the apparatus and particularly the length of the downpipe may vary. While the illustrated embodiment shows the head (2) located above and balanced on the rail (4), a variation of the invention would allow for the head (2) itself to have an underslung body depending from the wheels (20) that are guided along the rail (4) with an air outlet adaptor extending from the underslung portion of the head, over the rail (4) with a suitable outlet or outlets directed into the gutter.

The downpipe is shaped to locate the centre of gravity of the apparatus substantially below the wheels when the equipment is in use. This allows the device to balance itself without assistance during operation. The downpipe can be made of any materials that are appropriately rigid, preferably light, strong and commercially viable. This may include, but is not limited to, some or all of the following: ABS plastics, polyurethane, polyethylene or fibre-based materials.

The head can operate at increased levels of airflow thrust, to more effectively blow leaves and other debris out of the gutter. The output of the blower will preferably be around 600 $m^3$ per hour or more. For higher flow rate blowers (>1000 $m^3$ per hour) the head must be fitted with impeller suited to deal with the increased flow of air.

The invention thus provides gutter cleaning apparatus that is easy and relatively quick to use, mobile in both directions along a gutter and which is capable of moving past the cross supports or brackets which usually obstruct the travel of such equipment. This is especially appealing to commercial contractors deploying the apparatus for customers at various sites.

Very little maintenance and cleaning of the head, downpipe and flexible hose connector is required, partly because the apparatus expels air which is clean (does preferably not make use of a vacuum to suck debris from the gutter) and therefore almost no debris enters the head to interfere with moving parts.

A person suitably skilled in the art will appreciate that a number of variations may be made to the features of the embodiment described and illustrated without departing from the scope of the current invention. For example, the switching of the valve could be achieved through alternative means. Also the linkage between the downpipe and valve pivot pin could operate with a compression spring. The downpipe can in that case push instead of pull a lever on the pin to switch the valve. A linkage may also be operated through alternative means such as a control cable which can be operated from the blower.

The invention claimed is:

1. An air operated cleaning head for a roof gutter comprising a housing defining an airflow passage with an impeller located inside the passage, a gear arrangement connecting the impeller to a drive shaft and the drive shaft connected to at least one driven wheel of a wheel arrangement with guide formations to maintain the wheel arrangement in engagement along an outer rail of a roof gutter.

2. The cleaning head as claimed in claim 1 in which the head is locatable above the rail with an underslung counterbalance securable to the head to maintain it in balancing engagement on the rail.

3. The cleaning head as claimed in claim 2 in which the counterbalance is an underslung air supply downpipe extending from the head.

4. The cleaning head as claimed in claim 3 in which the downpipe is pivotably secured to the head.

5. The cleaning head as claimed in claim 1 in which the guide formations are spaced apart and configured to straddle the rail.

6. The cleaning head as claimed in claim 5 in which the guide formations are provided on either side of at least one wheel of the wheel arrangement.

7. The cleaning head as claimed in claim 6 in which the guide formations include at least one radial flange on the at least one wheel.

8. The cleaning head as claimed in claim 6 in which the guide formations include a radial spoke arrangement on the inside of the at least one wheel.

9. The cleaning head as claimed in claim 8 in which the spoke arrangement is freely rotatable on an axle of the at least one wheel.

10. The cleaning head as claimed in claim 2 in which the head includes a drive shaft switching means to reverse the rotation of the at least one driven wheel.

11. The cleaning head as claimed in claim 10 in which the impeller is supported in a dividing wall of the flow passage and for the switching means to alternate flow of air to either side of the wall.

12. The cleaning head as claimed in claim 11 in which the switching means includes a flap valve movable between seats on opposite sides of the dividing wall.

13. The cleaning head as claimed in claim 12 in which the counterbalance is an underslung air supply downpipe pivotably secured to the head and the flap valve is secured to a pivot pin with a lever extending from the pin away from the flap valve connected to the downpipe by a spring, whereby pivoting of the downpipe in one direction produces a bias on the flap valve in an opposite direction.

14. The cleaning head as claimed in claim 1 in which the wheel arrangement includes a pair of inline, spaced apart wheels.

15. The cleaning head as claimed in claim 14 in which both of the wheels are driven and each wheel is connected to the drive shaft by a belt.

16. The downpipe for a fluid operated roof gutter cleaning head as claimed in claim 3 comprising a first connection to the head and a second connection to a fluid line with a hollow, cranked body extending between the connections and configured to underlie the head and balance the head for guided movement along a gutter.

17. The downpipe as claimed in claim 16 having a cranked section of the body which depends from a substantially perpendicular first connection and the cranked section includes two substantially parallel conduits with a connecting crank inclined between the conduits.

* * * * *